United States Patent [19]

Kajiwara et al.

[11] 4,371,609

[45] Feb. 1, 1983

[54] FORMING METHOD OF A DYE IMAGE

[75] Inventors: Makoto Kajiwara; Akihiko Miyamoto, both of Odawara; Keiji Ohbayashi, Sagamihara; Masaru Iwagaki, Odawara, all of Japan

[73] Assignee: Konishiroku Photo Industry Co., Ltd., Japan

[21] Appl. No.: 283,911

[22] Filed: Jul. 16, 1981

[30] Foreign Application Priority Data

Jul. 19, 1980 [JP] Japan ..... 55/98175

[51] Int. Cl.[3] ..... G03C 7/00; G03C 5/32

[52] U.S. Cl. ..... 430/373; 430/374; 430/376; 430/405; 430/448; 430/467; 430/468; 430/470; 430/471; 430/483; 430/484; 430/486; 430/936; 430/943

[58] Field of Search ..... 430/373, 374, 376, 448, 430/467, 468, 470, 471, 483, 484, 486, 936, 943, 405

[56] References Cited

U.S. PATENT DOCUMENTS

| | | | |
|---|---|---|---|
| 3,674,490 | 7/1972 | Matejec | 430/374 |
| 4,045,225 | 8/1977 | Shimamura et al. | 430/943 |
| 4,094,682 | 6/1978 | Fujiwhara et al. | 430/943 |
| 4,113,490 | 9/1978 | Fujiwhara et al. | 430/943 |
| 4,277,556 | 7/1981 | Koboshi et al. | 430/393 |
| 4,301,236 | 11/1981 | Idota et al. | 430/943 |

FOREIGN PATENT DOCUMENTS

| | | | |
|---|---|---|---|
| 2527398 | 1/1976 | Fed. Rep. of Germany | 430/943 |

*Primary Examiner*—J. Travis Brown

*Attorney, Agent, or Firm*—Finnegan, Henderson, Farabow, Garrett & Dunner

[57] ABSTRACT

A method of forming dye images by processing a photographic material containing imagewise distributed catalyzer substance in the presence of hydrogen peroxide, a coupler and certain aromatic primary amine compounds.

6 Claims, No Drawings

FORMING METHOD OF A DYE IMAGE

The present invention relates to the forming method of the dye image and more particularly to the novel forming method of the dye image wherein the intensified dye image whose fog is restrained can be obtained by treating the silver halide photographic material with hydrogen peroxide.

Since the silver halide photographic material has a high photosensitivity and an excellent image quality etc., it has widely been used. For the silver halide photographic material that employs a large amount of silver, however, the recent shortage of silver resources and the consequent rise in prices of the raw material are considerably serious and thereby the development of the technology that can save the amount of silver is now being required. As a technology to meet such requirements, there has been known the so-called dye image intensification method wherein an image silver obtained by developing after the silver halide photographic material is given the imagewise exposure, is watched and with such silver as a catalyzer, an oxidized product of the developing agent is produced more effectively and thereby the dye image in high density is formed. With this method, it is possible to obtain a dye image extremely effectively and thus it is possible to reduce the amount of silver remarkably because the developed silver can be used repeatedly in a recycling manner. Many of such dye image intensification method for the silver halide photographic material have been known: Forming of dye by oxidization of paraphenylenediamine color developing agent caused by dissolution of hydrogen peroxide on the surface of silver catalyzer in the presence of coupler and by the consequent coupling with coupler (hereinafter called the color intensification), for example, is described on page 406 of "History of Color Photography" by J. S. Friedman, for example.

Further, the color intensification method on the surface of noble metal by cobalt complex is stated in Japanese Patent Publication Open to Public Inspection Nos. 9728/1973, 9729/1973, 48130/1973, 102340/1974 and 102341/1974, for example. In this intensification method, silver halide photographic material is developed by black and white developing agent or color developing agent and on the surface of the developed silver thus produced, oxidization and deoxidization of cobalt (III) complex and paraphenylenediamine color developing agent take place and by the consequent coupling of oxidized substance of color developing agent and coupler, the dye is formed.

Further, there has been stated in Japanese Patent Publication Open to Public Inspection Nos. 20025/1977 and 30430/1977 the color intensification method wherein hydrogen peroxide and cobalt complex are used together. The compound having the intensification action such as hydrogen peroxide and cobalt complex is called the intensifying agent and the bath having such intensifying agent is called the intensifying bath. The above-mentioned method has an effect to increase the dye image density effectively and therefore it is an effective means from the view point of saving the silver resources. However, it still is not put to practical use yet. The color intensification method wherein hydrogen peroxide is used has higher intensification activity than other intensification methods and it is desirable. However, even on the other portion than catalyzer substance (e.g. developed silver) with imagewise distribution, color developing agent is oxidized and its oxidized substance couples with coupler to form dye easily because of possible reason that the oxidizing power of hydrogen peroxide is too strong, which causes the photographic fog. Further, since color developing agent that is a reducing agent and hydrogen peroxide that is a oxidizing agent coexist, the preservability of the intensification bath containing hydrogen peroxide is considerably worsened. Namely, owing to the fact that color developing agent is dissolved by hydrogen peroxide and is reduced during preservation, the intensification activity falls and the maximum density (Dmax) and/or minimum density are deteriorated.

For the improvement of such drawbacks, various methods have been presented. For example, there has been known a method wherein benztriazole or the like is added as an antifoggant, which is stated in Research Disclosure No. 11660. However, such antifoggant has no effect when small amount thereof is used and when it is added in the amount with which an antifog effect is recognized, it adversely affects the imagewise catalyzer substance and the dye formation on the image area is retarded and Dmax remarkably falls.

Further, since there is a possibility that silver halide becomes a catalyzer for the dissolution of hydrogen peroxide in the silver halide photographic material, there is presented a method wherein silver halide that is not used for the image formation is removed by processing with a liquid (that is called the fixer) containing silver halide solubilization agent after the development processing of the silver halide photographic material, and before processing in the intensification bath, and then the only remaining imagewise silver is processed with the intensification liquid. Even with this method, however, the catalyzer activity of developed silver is remarkably reduced and consequently, the intensification of the dye image can not be expected.

Further, as is stated on page 447 of No. 128 "Hydrogen Peroxide" of American Chemical Society monograph series, various metals become the catalyzer for the dissolution of hydrogen peroxide and they reduce the stability of hydrogen peroxide. Though there has been a trial of adding the chelating agent such as polyamino carboxylic acid in order to sequester the metal in a very small amount (magnesium, calcium etc.) existing in the intensification bath, there has been almost no effect on the improvement in the preservability of the intensification bath and the fundamental cause for the drawbacks mentioned above lies in that color developing agent that is a reducing agent and hydrogen peroxide that is a oxidizing agent coexist in the intensification bath. In this manner, the intensification method with hydrogen peroxide has not been put to practical use yet in spite of the high intensification activity of hydrogen peroxide.

The intensification method with cobalt (III) complex, on the other hand, has a drawback that the intensification activity is low. This might be caused by the fact that cobalt (III) complex that has an oxidizing power that is relatively weak is used as an intensifying agent considering the stability of the complex itself. Further, with an intensification method with cobalt complex, the photographic fog takes place remarkably and in the liquid preservability, the phenomenon that Dmin rises is observed. For the purpose of the improvement of these drawbacks, there have been stated in Japanese Patent Publication Open to Public Inspection Nos. 11034/1977, 20831/1977, 8135/1978 the method to add various kinds of fog restrainers and stabilizers in the intensification bath or to make silver halide photographic material contain them therein, but no satisfactory improvement has been made yet.

Further, the intensification method wherein hydrogen peroxide and cobalt (III) complex are used jointly has a higher intensification activity compared with the case wherein hydrogen peroxide or cobalt (III) complex is used independently. However, drawbacks of occurrence of photographic fog and deterioration of liquid preservability both observed with hydrogen peroxide intensification and cobalt (III) complex intensification, become more notable and thereby it is now very difficult to put to practical use.

The present invention has been accomplished in order to improve the aforesaid drawbacks. Namely, the primary object of the present invention is to offer the forming method of a dye image with a great intensification effect wherein hydrogen peroxide with a high efficiency is used as an intensifying agent and the occurrence of photographic fog is restrained. The second object of the present invention is to offer the forming method of a dye image wherein the intensification liquid with an excellent preservability is used. Other objects of the present invention will be clarified by the following descriptions in this specification.

Aforesaid objects of the present invention are attained by forming the dye image in the presence of hydrogen peroxide, a coupler and an aromatic primary amine compound selected from the compounds shown in the following general formulas [I], [II] and [III], processing the photographic materials comprising imagewise distributed catalyzer substance

[I]

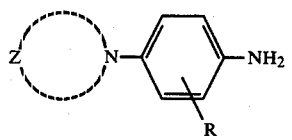

wherein, R represents hydrogen atom, an alkyl group (e.g. methyl group, ethyl group etc.), an alkoxy group (e.g. methoxy group, ethoxy group, butoxy group etc.), or a halogen atom and Z represents non-metal atom group necessary for the formation of a nitrogen containing 5 to 7 membered saturated hetero ring (e.g. morphonyl group, piperidinyl group, 3-hydroxypiperidinyl group, piperazinyl group, pyrolidinyl group, imidazolidinyl group and pyrazolidinyl group etc.).

[II]

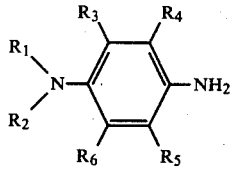

wherein, $R_1$ and $R_2$ independently represent a substituted or unsubstituted alkyl group (e.g. methyl group, ethyl group, propyl group, isopropyl group, butyl group, β-hydroxyethyl group, β-methanesulfoneamideethyl group, β-methoxyethyl β-ethoxyethyl and $R_1$ may be same to or different from $R_2$) and $R_3$, $R_4$, $R_5$ and $R_6$ independently represent hydrogen atom, unsubstituted or substituted alkyl group (e.g. methyl group, ethyl group and methylol group), alkoxy group (e.g. methoxy group and ethoxy group etc.) or halogen atom provided that at least one of $R_3$, $R_4$, $R_5$ and $R_6$ is halogen atom.

[III]

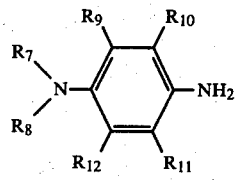

wherein, $R_7$ and $R_8$ independently represent unsubstituted or substituted alkyl group (e.g. methyl group, ethyl group, propyl group, isopropyl group, butyl group, β-hydroxyethyl group, β-methanesulfonamideethyl group, β-methoxyethyl group and β-ethoxyethyl group and $R_7$ may be same to or different from $R_8$) and $R_9$, $R_{10}$, $R_{11}$ and $R_{12}$ independently represent hydrogen atom, an unsubstituted or subtituted alkyl group (e.g. methyl group, ethyl group and methylol group etc.), alkoxy group (e.g. methoxy group and ethoxy group etc.) and amino group provided that at least one of $R_9$ and $R_{12}$ is substituted or unsubstituted alkyl group, alkoxy group or amino group.

Namely, with the present invention, it is possible to reduce Dmin remarkably with almost no reduction of Dmax by intensifying dye images of photographic material that comprises imagewise distributed catalyzer substance (e.g. developed silver) in the presence of hydrogen peroxide and an aromatic primary amine compound selected from compounds shown in the general formulas [I], [II] and [III] and it is further possible to obtain the intensification liquid whose preservability has been improved.

Typical concrete examples of the compounds (hereinafter called the aromatic primary amine compound of the present invention) which are used for the present invention and are shown in the general formulas [I], [II] and [III], will be shown next. However, the present invention shall not be limited to these examples.

[Illustrated compounds]

(IC-1)

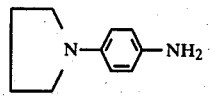

(IC-2)

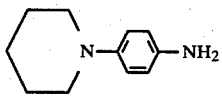

(IC-3)

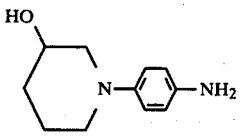

(IC-4)

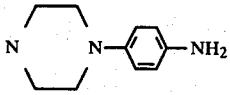

(IC-5)

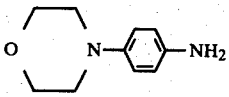

-continued

[Illustrated compounds]

(IC-6)

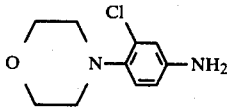

(IC-7)

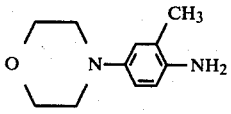

(IC-8)

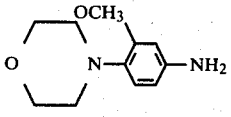

(IC-9)

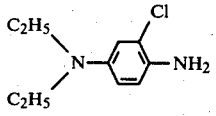

(IC-10)

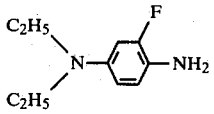

(IC-11)

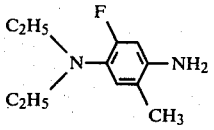

(IC-12)

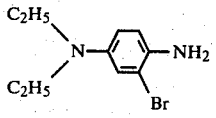

(IC-13)

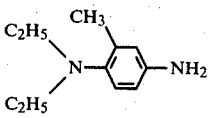

(IC-14)

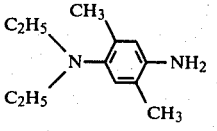

(IC-15)

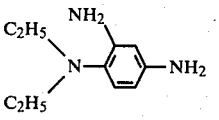

(IC-16)

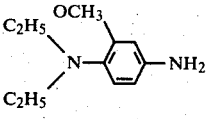

(IC-17)

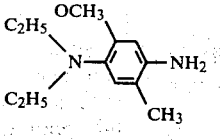

-continued

[Illustrated compounds]

(IC-18)

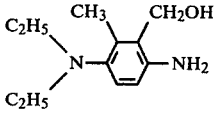

The method to synthesize these compounds is known and those in the art can easily synthesize. For the synthesis of these compounds, Bent, Dessloch, Fassett, James, Ruby, Sterner, Vittum, Weissberger; J Am Chem Soc. 73,3100 (1951) and Bent, Brown, Glesmanss, Harnish; Phot. Sci. Eng. 8,125 (1964) can be referred.

In case aromatic primary amine compound of the present invention is contained in the intensification liquid and used, it is preferable that 0.1 g–100 g and especially 0.5 g–20 g thereof will be added per 1 l. Further, the aromatic primary amine compound and coupler of the present invention may be contained in the silver halide photographic material and in this case, 0.1 mol–10 mol and preferably 0.5 mol–5 mol will be used per 1 mol of coupler. Aromatic primary amine compounds, when it is contained in the silver halide photographic material, can be used as it is or as salt with inorganic acid (e.g. hydrochloric acid, sulfuric acid, phosphoric acid, boracic acid and nitric acid etc.) or as salt with organic acid or its derivative (e.g. sulfonic acid, carboxylic acid, boracic acid, sulfaminic acid, sulfinic acid, hydroxamic acid, sulfohydroxamic acid, polymersulfonic acid, strong acid phenol, phosphoric ester, sulfuric ester, thiosulfuric ester and thiosulfuric acid 8-ester etc.) or as salt with metal complex (e.g. metal complex of nickel, zinc, lead, cadmium, copper and cobalt) and further as precursor (e.g. schiff base, imido compound and urethane compound etc.).

The compound used for the present invention and shown in the general formulas [I], [II] or [III] can be contained in any layer containing hydrophile colloid on the same side as the photosensitive silver halide emulsion layer on the surface of the support for color photography element. As such an layer, a protection layer, a photosensitive layer containing silver halide emulsion, a non photosensitive intermediate layer and an image-receiving layer for color diffusion transfer process (containing even oxidizing agent) are given and it is preferable that the compound is contained in the photosensitive layer or in the upper and/or lower hydrophile colloid layer that adjoins the photosensitive layer. The method with which the aforesaid compound is contained in the hydrophile colloid solution is as follows. Namely, when the aforesaid compound of the present invention is hydrophilic, its water solution (it may contain the solvent that is easily soluble in water) can be added to hydrophile colloid solution. Further, when said compound is hydrophobic (less soluble in water), a latex dispersion process and an oil-drop-in-water type emulsification dispersion process are especially effective. Such dispersion processes have been known widely and a latex dispersion process and its effect are stated in Japanese Patent Publication Open to Public Inspection Nos. 74538/1974, 59943/1976, 32552/1979 and on pages 77–79 of Research Disclosure, August, 1976, No. 14850.

Appropriate latex, for example, is monomeric homopolymer, copolymer and terpolymer such as styrene, ethyl acrylate, n-butylacrylate, n-butylmethacrylate, 2-acetoacetoxyethylmethacrylate, 2-(methacryloyloxy)ethyltrimethylammoniummethosulphate, 3-(methacryloyloxy)propane-1-sulphonic acid sodium salt, N-isopropylacrylicamide, N-[2-(2-methyl-4-oxobenzyl)] acrylicamide, 2-acrylicamide-2-methylpropanesulphonic acid. As an oil-drop-in-water type emulsification dispersion process, the publicly known method wherein hydrophobic additive such as coupler is dispersed can be applied.

Catalyzer substance that distributes in the imagewise form is developed silver obtained from exposed silver halide reduced by developing agent, for example. Further, nonmigratory cobalt (III) reaction product that is formed when silver is bleached by cobalt (III) complex typified by cobalt (III) hexaammine is effective as a catalyzer. Hydrogen peroxide intensification method wherein cobalt (III) reaction product is a catalyzer is stated in detail in Japanese Patent Publication Open to Public Inspection Nos. 20025/1977, 30430/1977, for example.

Aromatic primary amine compound of the present invention is oxidized by hydrogen peroxide in the presence of catalyzer substance but in the area where no catalyzer exists, it is oxidized with a very slow oxidization reaction speed and it is regarded as a compound that is not substantially oxidized.

In the present invention, hydrogen peroxide is used as an intensifying agent. For example, as is stated on pages 605–694 in the volume 15 of "Shin Jikken Kagaku Koza" (Maruzen) (1971), hydrogen peroxide has a high oxidizing power in the presence of various kinds of catalyzers and it is easy to handle as a water solution. Further, it has merits that it is less expensive compared with other peroxides and it does not produce any reaction product that adversely affect the processing liquid of salt. Regarding the adding amount of hydrogen peroxide in the present invention, it is desirable to use with a concentration of 0.005–1 mol per 1 l of intensifying liquid.

The pH of the intensifying liquid is in the range of 7–14 and especially the range of 8–13 is preferable. Intensification treatment is conducted in the temperature range of 10° C.–70° C. and especially in the range of 20° C.–50° C. The intensifying liquid used for the present invention is preferably used as an intensifying bath but it may be used in a way wherein silver halide photographic material is sprayed with the intensifying liquid.

It is possible to make the intensifying liquid used for the present invention contain other known developer component compounds. For example, alkaline agent for the intensifying liquid used for the present invention and, as a buffer etc., sodium hydroxide, ammonium hydroxide, sodium carbonate, sodium sulfate, sodium sulfite, tertiary sodium phosphate, potassium metaboric acid and borax can be used independently or in combination thereof. Further, for giving buffer function or for the circumstances of preparation, various kinds of salts such as sodium hydrogenphosphate or potassium hydrogenphosphate, sodium dihydrogenphosphate or potassium dihydrogenphosphate, sodium bicarbonate or potassium bicarbonate, boric acid and alkali nitrate etc. may be used.

It is possible to add any developer accelerator to the intensifying liquid used for the present invention as occasion demands. Such developer accelerator includes pyridinium compound and other cationic compound, neutral salt such as thallium nitrate and potassium nitrate, polyethylene glycol and its derivative, organic amine, ethanol amine, ethylene diamine, diethanolamine, benzyl alcohol and phenylethyl alcohol.

Further, polyphosphoric acid compound and aminopolycarboxylic acid etc. can be used as a hardwater softener and besides them, calcium sequestering agent or magnesium sequestering agent can be used for the intensifying liquid. Organic solvent can be contained for the necessities such as raising the solubility of the composite of the intensifying liquid or the like. Such organic solvent includes ethylene glycol, hexylene glycol, diethylene glycol, methylcellosolve, methanol, ethanol, acetone, triethylene glycol, dimethylformamide and dimethylsulfoxide.

There are several methods to obtain the (intensified) dye image having extremely low Dmin and high Dmax according to the present invention. For example, the developed silver is produced by processing silver halide photographic material containing coupler exposed in imagewise manner with black and white developer and with hydrogen peroxide and intensifying liquid containing aromatic primary amine compound of the present invention (further, an additive such as alkaline agent), dye images are formed successively. Concretely, hydrogen peroxide oxidizes aromatic primary amine compound of the present invention in the intensifying bath with the surface of image silver as a catalyzer, and an oxidized substance therefrom makes a coupling reaction with a coupler and thus dye images are formed. As stated above, if treatment is made with fixer before the intensification treatment for the purpose to remove the silver halide not used for formation of silver image, catalytic activity of the image silver falls remarkably and therefore it is not preferable that fixing treatment is made before intensification treatment. To the intensifying liquid (bath) used for the present invention, cobalt (III) complex can be added as occasion demands. In this case, cobalt (III) complex oxidizes developed silver and cobalt (II) reaction product is produced and said cobalt (II) reaction product is a substance that does not move in the hydrophile colloid layer, namely it is a nonmigratory substance and it becomes a catalyzer substance that is distributed in an imagewise form. Said cobalt (III) complex is a complex with a coordination number of 6 and it is preferably the one having a ligand selected from the group consisting of ammine, ethylenediamine, diethylenetriamine, triethylenetetramine, nitrate, nitrite, azide, chloride, thiocyanate, isocyanate, water and carbonate. More preferably, it is the one wherein said cobalt (III) complex has at least 5 or more ammine ligands and at least two ethylenediamine ligands or at least one triethylenetetraamine ligand.

Further, as another method to obtain an intensified dye image, it is possible to make black and white developer contain aromatic primary amine compound of the present invention. When processing with said black and white developer, it is considered that the black and white developing agent develops silver halide photographic material having couplers that is given an imagewise exposure. Successively, by processing with the intensifying liquid containing additives such as hydrogen proxide and alkaline agent, and at need, cobalt (III) complex, dye images are formed. In the present invention, aromatic primary amine compound of the present invention that is oxidized by hydrogen peroxide on the surface of developed silver and successively has a coupling reaction with coupler is used in the quantity which adheres to silver halide photographic material and is carried in from the previous bath namely black and white developer bath.

Further, as another method to obtain an intensified dye image, it is possible to make coupler-containing silver halide photographic material contain aromatic primary amine compound of the present invention and black and white developing agent (e.g. hydroquinone, methol, 1-phenyl-3-pyrazolidone etc.). By using said silver halide photographic material, it is possible to make developing and intensifying treatment with a single bath. Namely, by processing said silver halide photographic material having an imagewise exposure with additives such as hydrogen peroxide and alkaline agent and further with developing and intensifying bath containing cobalt (III) complex at need, dye images are formed by the development of silver halide with black and white developing agent and by following hydrogen peroxide intensification with a catalyzer of developed silver or of nonmigratory cobalt (III) complex produced by bleaching the developed silver.

As aforesaid black and white developing agent, following compounds may be used independently or in combination thereof, that is, polyhydroxybenzenes represented by hydroquinone, toluhydroquinone and 2.5-dimethylhydroquinone etc. for example, 3-pyrazolidones represented by 1-phenyl-3-pyrazolidone and 1-phenyl-4-methyl-3-pyrazolidone etc. for example, aminophenols represented by o-aminophenol and p-aminophenol etc. for example, 1-aryl-3-aminopyrazolines represented by 1-(p-hydroxyphenyl)-3-aminopyrazolidone and 1-(p-methylaminophenyl)-3-pyrazoline etc. for example, ascorbic acid and other compounds stated as developing agent in Chapter 13 of "The Theory of Photographic Process" written by C. E. K. Mess and T. H. Jamee, 3rd edition (1966, Macmillan Co., N.Y.) and on pages 16–30 of "Photographic Processing Chemistry" written by L. P. A. Mason (1966, The Focal Press, London).

Further, in another method to obtain intensified dye images, nonmigratory cobalt (II) is produced by dipping in liquid containing cobalt (III) complex after the black and white development and then dye images are formed by treating with the intensifying liquid containing hydrogen peroxide and aromatic primary amine compound of the present invention.

In order to remove remaining image silver after the dye images with hydrogen peroxide internsification are formed according to the present invention, an image silver may be halogenated again by bleaching solution containing red prussiate and aminopolycarbonic acid ferric complex salt etc. for example and may successively be processed by fixer containing silver halide solvent (e.g. thiosulfate, thiourea, ethylene thiourea, thiocyanate, sulfur-containing dithiol and sulfur-containing dibasic acid etc.). Further, both bleaching and fixing can be conducted in the same bath.

Silver halides used for silver halide color photographic material intensified in the present invention are, for example, silver chloride, silver bromide, silver chloro-bromide, silver iodo-bromide, silver chloro-iodide and silver chloro-iodo-bromide and silver chloride, silver chloro-bromide and silver chloro-iodide are preferable in particular. These silver halides are prepared in any method that is publicly known. For example, silver halide used for the present invention may be so-called conversion emulsion, Lippmann emulsion, core-shell type emulsion, epitaxial junction emulsion or the one that is optically or chemically given a photographic fog in advance and these are properly selected according to the type and application of photographic material. Also, the type of silver halide, containing amount and mixture ratio of silver halide, average grain size and size distribution are similarly selected properly according to the type and application of photographic material. For example, for the photographic material wherein comparatively low sensitivity and high image quality are required, the emulsion mainly composed of silver chloride emulsion that is of fine grain and narrow size distribution is used and for photographic material wherein comparatively high sensitivity is required, on the other hand, the emulsion whose grain size is comparatively large and whose containing amount of silver chloride is small is used. For the direct reversal photographic material, on the other hand, prefogged direct positive type emulsion and internal latent image type emulsion are used. And these silver halides may be chemically sensitized independently or in combination (e.g. the combination of gold sensitizer and sulfur sensitizer or the combination of gold sensitizer and selenium sensitizer etc.) by active gelatin, sulfur sensitizer (e.g. allylthiocarbamide, thiourea, and cystine etc.), selenium sensitizer, reduction sensitizer (e.g. stannous salt, polyamine etc.), noble metal sensitizer [e.g. gold sensitizer, concretely, potassium aurithiocyanate, potassium chloroaurate, 2-aurosulfobenzothiazolmethochloride etc., or, e.g. sensitizer of water-soluble salt such as ruthenium, rhodium and iridium etc., concretely, ammoniumchloroparadate, potassiumchloroplatinate and sodiumchloroparadite etc. (Some of these will act as a sensitizer or as a fogging agent according to the amount thereof)].

Further, these silver halides can be optically sensitized for the desired range of wave length and for example, they can be optically sensitized independently or in combination (e.g. hyper sensitization) by cyanine dye such as zero methine dye, monomethine dye, dimethine dye or trimethine dye etc. or by optical sensitizer such as merocyanine dye etc.

And this silver halide is dispersed in a proper protective colloid and composes a photosensitive layer and as a protective colloid used for a photosensitive layer and other composing layers (e.g. composing elements such as an interlayer, a protective layer and a filter layer etc.), gelatin is generally used and besides it, derivative gelatin, albumin in colloidal state, cellulose derivative or synthetic resin such as polyvinyl compound etc. are used independently or in combination thereof. Further, acetylcellulose containing 19–26% of acetyl and water-soluble ethanolaminecelluloseacetate can be used in combination.

Regarding couplers used in the present invention, all of the publicly known couplers can be used. As a yellow coupler, benzoylacetanilide compound and pivaloylacetanilide compound etc. are available, as a magenta coupler, 5-pyrazolone compound, pyrazolotriazole compound, pyrazolinobenzimidazole compound, indazolone compound and cyanoacetyl compound etc. are available and as a cyan coupler, phenol compound, diacylaminophenol compound and naphtol compound etc. are given. These couplers may be of either of so-called two equivalent type of four equivalent type. Further, they can contain fluorine-containing substituent for the tone adjustment of the dye that is formed by the reaction with oxidized substance of aromatic primary amine compound of the present invention. Further, it is possible, in combination with these couplers, to use azo type colored coupler for automasking, osazone type compound and development diffusible dye releasing coupler. Thereupon, it is recommendable to use so-called colorless coupler that is colorless before the color development and aforesaid masking coupler in combination thereof. For the further improvement in the photographic characteristics, it is possible to include the couplers called competing coupler, DIR coupler and BAR (Bleach Accelerator Releasing) coupler etc.

By coating onto the support the silver halide emulsion containing the coupler for photographic use controlled as mentioned above together with a foundation layer, an interlayer, a filter layer, a curl-prevention layer and a protective layer at need, the silver halide photographic material used in the present invention is prepared. As a support to be used at this time, the support in a film form or a sheet form of paper, laminate paper (e.g. laminated substance of polyethylene and paper), glass, celluloseacetate, cellulosenitrate, polyester, polycarbonate, polyamide, polystyrene and polyolefin etc. can be given. And these supports can be given various types of surface treatments including a hydrophilic treatment for the purpose of improving an adhesion thereof to each structure and saponification treatment, corona discharge treatment, subbing treatment and setting treatment, for example, are given thereto.

The photosensitive layer and/or other constitution layers (e.g. an interlayer, a foundation layer, a filter layer, a protective layer and an image receiving layer etc.) of the photographic material used in the present invention can contain various kinds of additives for the photographic use according to the purpose. As such additives for the photographic use, stabilizer (mercury compound, triazoles, azaindenes, quaternarybenzothiazolium, zinc or cadmium salt etc.); sensitizer of quaternary ammonium salt and polyethyleneglycols etc.; film properties improving agent e.g. glycerin, dihydroxyalkane such as 1,5-pentadiol, ester of ethylenebisglycolic acid, bisethoxydiethyleneglycolsuccinate, amide of acid in acrylic acid, emulsified dispersant of polymer; hardener e.g. halogen-substituted fatty acid such as formaldehyde, mucochromic acid and mucobromic acid, compound having acid anhydride group, dicarboxylic acid chloride, disulfonic acid chloride, biester of methanesulfonic acid, sodium bisulfite derivative of dialdehyde separated by carbon atom with 2–3 aldehyde groups, bisaziridine and ethyleneimines etc.; spreading agent, e.g. saponin, lauryl of polyethyleneglycol or oleylmonoether, sulfonated and alkylated polyethyleneglycol salts etc.; covering aid e.g. sulfosuccinic acid salt etc.; organic solvent e.g. coupler solvent (high boiling point organic solvent and/or low boiling point organic solvent concretely dibutylphthalate, tricresylphosphate, aceton, methanol, ethanol and ethylenecellosolve etc.); so-called DIR compound that releases a development inhibitor and concurrently produces colorless compound substantially at the time of color development, antistatic agent, foam extinguisher, ultraviolet rays absorbing agent, fluorescencewhitening agent, anti-slip agent, matting agent and antihalation agent or anti-irradiation agent, for example, are used independently or in combination thereof.

The present invention will be explained more concretely with the aid of examples as follows and an embodiment of the present invention shall never be limited by such examples.

EXAMPLE 1

A sample of silver halide color photographic material was prepared by coating following layers in order onto the paper support having resin coating. In all the following examples, the amount of each type of compound to be added into the silver halide color photographic material represent the amount per 100 $cm^2$.

The 2-(1-benzyl-2,4-dioxyimidazolidine-3-yl)-2-pivalyl-2'-chloro-5'-[4-(2,4-di-t-pentylphenoxy)-butaneamide]acetanilide to be used as a coupler was dissolved in dibutylphthalate and after the protect dispersion in gelatin solution, it was mixed with blue-sensitive silver chlorobromide emulsion (40 mol% of silver chloride) and then was coated. The coating amount of coupler and silver used at this time was 8.2 mg for coupler and 1.5 mg for silver respectively.

Onto this layer, a gelatin interlayer containing dioctylhydroquinone was established.

Onto this layer, 3-{2-chloro-5-[1-(octadecyl)succinimide]anilino}-1-(2,4,6-trichlorophenyl)-5-pyrazolone to be used as a coupler was dissolved in dibutylphthalate and after the protect dispersion in gelatin solution, it was mixed with green-sensitive silver chlorobromide emulsion (50 mol% of silver chloride) and then was coated. The amount of coupler used at this time was 4.3 mg and 0.97 mg was for silver.

Onto this layer, gelatin solution of dioctylhydroquinone was coated as an anti-stain layer.

Further onto this layer, 2-[2-(2,4-di-t-pentylphenoxy)butaneamide]-4,6-dichloro-5-methylphenol to be used as a coupler was dissolved in dibutylphthalate and after the protect dispersion in gelatin solution, it was mixed with red-sensitive silver chlorobromide emulsion (50% of silver chloride) and then was coated. The coating amount of coupler used at this time was 2.9 mg and 0.73 mg was for silver.

Further onto this layer, gelatin protection layer containing 10 mg of gelatin was coated and dried.

Samples thus obtained was given a wedge exposure and then was given following processes.

| | | |
|---|---|---|
| [Processing step I] | | |
| Black and white development | 25° C. | 1 minute |
| Intensification | 30° C. | 3 minutes |
| Bleach-fix | 30° C. | 2 minutes |
| Washing | 30° C. | 2 minutes |
| [Composition of each processing liquid] | | |
| (Black and white developer) | | |
| Hydroquinone | | 3 g |
| 1-phenyl-3-pyrazolidone | | 0.5 g |
| Potassium sulfite | | 12 g |
| Potassium carbonate | | 20 g |
| Potassium bromide | | 0.5 g |
| Add water to make | | 1 l |
| (Intensifying liquid) | | |
| Hydrogen peroxide solution (35%) | | 10 ml |
| Potassium carbonate | | 10 g |
| Add water to make | | 1 l |
| Adjust to pH 11.0 with potassium hydroxide | | |

Intensifying liquid [A]–[F] were prepared by adding compounds shown in following Table 1 to the intensifying liquid with aforesaid composition and these intensifying liquid [A]–[F] were used for the intensifying bath.

TABLE 1

Intensifying

TABLE 1-continued

| liquid | Aromatic primary amine compound | |
|---|---|---|
| [A] | Illustrated compound (IC-5) | 3 g/l |
| [B] | Illustrated compound (IC-9) | 3 g/l |
| [C] | Illustrated compound (IC-14) | 3 g/l |
| [D] | Comparison compound (1) | 3 g/l |
| [E] | Comparison compound (2) | 3 g/l |
| [F] | Comparison compound (3) | 3 g/l |

Comparison compound (1): 4-amino-3-methyl-N—ethyl-N—(β-methanesulfonamideethyl)aniline
Comparison compound (2): 4-amino-3-(β-methanesulfonamide-ethyl)-N,N—diethylaniline
Comparison compound (3): 4-amino-3-methyl-N—ethyl-N—methoxyethyl-aniline

| (Bleach-fix bath) | |
|---|---|
| Ammonium thiosulfate | 100 g |
| Potassium sulfite | 5 g |
| Na[Fe(EDTA)] | 40 g |
| EDTA | 4 g |
| Add water to make | 1 l |

Intensifying liquid immediately after the preparation and the one kept at the room temperature for one week were used.

Further, as a comparison treatment, the wedge exposure was given to the aforesaid samples and then the following processes were given to the samples.

| [Processing step] | | |
|---|---|---|
| Color development | 30° C. | 3 minutes |
| Bleach-fix | 30° C. | 2 minutes |
| Washing | 30° C. | 2 minutes |
| (Composition of color developer) | | |
| Sodium carbonate anhydride | 26 g | |
| Sodium bicarbonate anhydride | 3.5 g | |
| Potassium sulfite | 18 g | |
| Potassium bromide | 1.3 g | |
| Sodium chloride | 0.2 g | |
| Potassium hydroxide | 0.4 g | |
| Hydroxylamine sulfate | 2 g | |
| 4-amino-3-methyl-N—ethyl-N—(β-methanesulfonamideethyl)-aniline | 5 g | |
| Add water to make (pH 10.2) | 1 l | |

The bleach-fix bath that is similar to the one used in [Processing step I] was used. Sensitometry was given to the samples obtained and densities of dye images obtained are shown in Table 2.

TABLE 2

| Density Intensifying liquid | Immediately after preparation | | | | | | After preservation for one week | | | | | |
|---|---|---|---|---|---|---|---|---|---|---|---|---|
| | Red | | Green | | Blue | | Red | | Green | | Blue | |
| | Dmax | Dmin | Dmax | Dmin | Dmax | Dmin | Dmax | Dmin | Dmax | Dmin | Dmax | Dmin |
| [A] Present invention | 2.22 | 0.09 | 2.18 | 0.10 | 2.01 | 0.15 | 2.12 | 0.14 | 2.14 | 0.12 | 1.98 | 0.16 |
| [B] Present invention | 2.38 | 0.14 | 2.39 | 0.16 | 2.17 | 0.14 | 2.06 | 0.18 | 2.29 | 0.18 | 2.09 | 0.14 |
| [C] Present invention | 2.42 | 0.11 | 2.46 | 0.12 | 2.23 | 0.15 | 2.18 | 0.15 | 2.33 | 0.16 | 2.20 | 0.17 |
| [D] Comparison | 2.56 | 1.10 | 2.54 | 1.23 | 2.22 | 1.47 | 1.44 | 0.95 | 1.54 | 1.00 | 1.26 | 0.99 |
| [E] Comparison | 2.78 | 1.48 | 2.68 | 1.55 | 2.28 | 1.54 | 1.38 | 1.01 | 1.58 | 1.27 | 1.33 | 1.01 |
| [F] Comparison | 2.89 | 1.53 | 2.87 | 1.55 | 2.45 | 1.60 | 1.18 | 1.05 | 1.57 | 1.35 | 1.28 | 1.03 |
| Comparison treatment | 1.01 | 0.01 | 1.21 | 0.02 | 0.92 | 0.01 | 0.97 | 0.01 | 1.11 | 0.02 | 0.88 | 0.01 |

As is clear from Table 2, sufficient Dmax can not be obtained with an ordinary color development such as comparison treatment but with intensifying treatment, the Dmax goes up considerably. When comparison compounds are used, however, Dmin also goes up remarkably together with the rise of Dmax. When aromatic primary amine compound of the present invention is used, to the contrary, the rise of Dmin is slight compared with the rise of Dmax and thereby satisfactory dye images are obtained. Further, concerning intensifying liquid containing aromatic primary amine compound of the present invention, even after the preservation thereof for one week, the fall of Dmax is slight and Dmin is almost the same as the one for the treatment immediately after the preparation.

Thus, it is noticed that excellent dye images with low fog and sufficiently high Dmax are obtained with hydrogen peroxide intensifying method wherein aromatic primary amine compound of the present invention is used, and keeping property of said intensifying liquid is extremely excellent.

EXAMPLE 2

After samples of silver halide photographic material prepared in example 1 were given a wedge exposure, they were processed according to [Processing step I]. However, as intensifying liquid, the one wherein cobalt (III) hexammine chloride ($[Co(NH_3)_6]Cl_3$) is added to intensifying liquid [A] and [F] respectively by 2 g per 1 l of intensifying liquid was used and the time for intensification treatment was 1.5 minutes. Dye image densities were measured according to example 1 and the results thereof are shown in Table 3.

TABLE 3

| Intensifying liquid | Red | | Green | | Blue | |
|---|---|---|---|---|---|---|
| | Dmin | Dmax | Dmin | Dmax | Dmin | Dmax |
| [A] + Cobalthexamine | 0.10 | 2.64 | 0.12 | 2.58 | 0.15 | 2.27 |
| [F] + Cobalthexamine | 1.85 | 3.18 | 1.90 | 3.14 | 1.77 | 2.88 |

As is obvious from Table 3, it is noticed that intensification activity can be raised more by adding cobalt complex to intensifying bath. However, when comparison compounds are used, the rise of Dmin becomes more notable.

EXAMPLE 3

After samples of silver halide photographic material prepared in example 1 were given a wedge exposure, they were processed according to following steps.

| [Processing step III] | | |
|---|---|---|
| Black and white development | 25° C. | 2 minutes |
| Intensification | 30° C. | 3 minutes |
| Bleach-fix | 30° C. | 2 minutes |
| Washing | 30° C. | 2 minutes |
| [Composition of each processing liquid] | | |
| (Black and white developer) | | |
| Metol | | 2 g |

-continued

| | |
|---|---|
| Ascorbic Acid | 8 g |
| Potassium carbonate | 20 g |
| Potassium bromide | 0.5 g |
| Add water to make | 1 l(pH 9.6) |

By adding aromatic primary amine compound of the present invention shown in Table 4 mentioned below to black and white developer with aforesaid composition, black and white developer [G], [H], [I] and [J] were prepared.

TABLE 4

| Black and white developer | Aromatic primary amine compound | |
|---|---|---|
| [G] | Illustrated compound (IC-4) | 4 g/l |
| [H] | Illustrated compound (IC-10) | 4 g/l |
| [I] | Illustrated compound (IC-16) | 4 g/l |
| [J] | Comparison compound (2) | 4 g/l |
| (Intensifying liquid) | | |
| Hydrogen peroxide solution (35%) | | 20 ml |
| Potassium carbonate | | 10 g |
| (Prepare to pH 11.5 with potassium-hydroxide) | | |

Regarding bleach-fix bath, the one that is the same as example 1 was used.

Dye image densities obtained are shown in Table 5.

TABLE 5

| Black and white developer | Red | | Green | | Blue | |
|---|---|---|---|---|---|---|
| | Dmin | Dmax | Dmin | Dmax | Dmin | Dmax |
| [G] | 0.08 | 2.14 | 0.11 | 2.17 | 0.14 | 2.00 |
| [H] | 0.11 | 2.22 | 0.13 | 2.31 | 0.12 | 2.08 |
| [I] | 0.09 | 2.20 | 0.11 | 2.26 | 0.11 | 2.14 |
| [J] | 1.18 | 2.56 | 1.42 | 2.68 | 1.19 | 2.20 |

As is clear from Table 5, it is noticed that sufficiently high density can be obtained even with a method wherein aromatic primary amine compound of the present invention does not substantially exist in the intensifying liquid and dye images are formed only by said aromatic primary amine compound adheres to silver halide photographic material from the previous bath and carried into the intensifying liquid.

EXAMPLE 4

As a coupler, 2-(α-di-t-pentylphenoxy-n-butylamino)-4,6-dichloro-5-methylphenol was dissolved in dibutylphthalate and after the protect dispersion in gelatin solution, it was mixed with silver chlorobromide emulsion (50% of silver chloride) and then it was coated and dried on the resin coated paper support after the addition of each compound shown in following Table 6 and thus samples were prepared. At this time, the amount of silver was 0.9 mg and that of coupler was 3.2 mg.

TABLE 6

| Sample | Compound | |
|---|---|---|
| [K] | Illustrated compound (IC-5) | 3 mg |
| | Hydroquinone | 6 mg |
| [L] | Illustrated compound (IC-9) | 3.5 mg |
| | Hydroquinone | 6 mg |
| [M] | Illustrated compound (IC-13) | 3 mg |
| | 1-phenyl-3-pyrazolidone | 1 mg |
| [N] | Comparison compound (1) | 3 mg |

TABLE 6-continued

| Sample | Compound | |
|---|---|---|
| | 1-phenyl-3-pyrazolidone | 1 mg |

After the samples were given a wedge exposure, they were processed according to the following steps.

| | | |
|---|---|---|
| [Processing step IV] | | |
| Development, intensification | 30° C. | 3 minutes |
| Bleach-fix | 30° C. | 2 minutes |
| Washing | 30° C. | 2 minutes |
| [Composition of each processing liquid] | | |
| (Developing intensifying liquid) | | |
| Hydrogen peroxide solution (35%) | | 10 ml |
| Potassium carbonate | | 15 g |
| Add water to make | | 1 l |

Bleach-fix bath used was the same as the one for example 1. Dye image densities obtained are shown in Table 7.

TABLE 7

| Density | | Sample | | | |
|---|---|---|---|---|---|
| | | [K] | [L] | [M] | [N] |
| Red | Dmin | 0.12 | 0.14 | 0.13 | 1.21 |
| | Dmax | 2.32 | 2.29 | 2.44 | 1.66 |

As Table 7 shows clearly, it is noticed that excellent dye images with low Dmin and high Dmax can be obtained even when the development and the intensification are made in the same bath if aromatic primary amine of the present invention and black and white developer are contained in the silver halide photographic material. And keeping property of liquid was further improved because in the intensifying bath, there was nothing but alkaline agent with an exception of hydrogen peroxide.

What is claimed is:

1. A method for the formation of a dye image which comprises processing a photographic material comprising imagewise distributed catalyzer substance in the presence of hydrogen peroxide, a coupler and an aromatic primary amine compound selected from the compounds represented by the general formulas [I], [II] and [III] below;

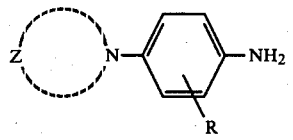

[I]

[wherein, R represents hydrogen atom, an alkyl group, an alkoxy group and a halogen atom and Z represents non-metallic atom group necessary for the formation of a nitrogen containing 5 to 7 membered saturated hetero ring],

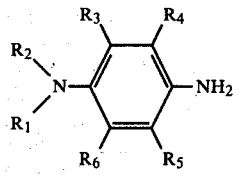

[II]

[wherein, $R_1$ and $R_2$ independently represent a substituted or unsubstituted alkyl group, $R_3$, $R_4$, $R_5$ and $R_6$ independently represent hydrogen atom, substituted or unsubstituted alkyl group, alkoxy group or halogen atom provided that at least one of $R_3$, $R_4$, $R_5$ and $R_6$ is a halogen atom],

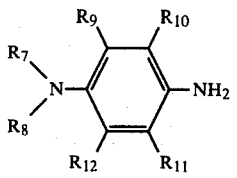

[III]

[wherein, $R_7$ and $R_8$ independently represent a substituted or unsubstituted alkyl group, $R_9$, $R_{10}$, $R_{11}$ and $R_{12}$ independently represent a hydrogen atom, a substituted or unsubstituted alkyl group, alkoxy group or amino group provided that at least one of $R_9$ and $R_{12}$ is a substituted or unsubstituted alkyl group, alkoxy group or amino group].

2. A method according to claim 1, wherein the catalyzer material is silver.

3. A method according to claim 1, wherein the coupler is contained in the photographic materials.

4. A method according to claim 1, wherein the aromatic primary amine compound is contained in the photographic materials.

5. A method according to claim 1, wherein said photographic material is processed by a solution containing hydrogen peroxide and said aromatic primary amine.

6. A method according to claim 2, wherein nitrogen containing saturated hetero ring is morphonyl group, piperidinyl group, 3-hydroxypiperidinyl group, piperazinyl group, pyrolidinyl group, imidazolidinyl group, or pyrazolidinyl group.

* * * * *